US007406793B2

(12) United States Patent
McClellan

(10) Patent No.: US 7,406,793 B2
(45) Date of Patent: Aug. 5, 2008

(54) REVOLVER HANDGUN HAVING AN AMBIDEXTROUS, INTEGRATED, COMBINED, LOCKABLE SAFETY AND HANDGUN LOCK AND A METHOD OF OPERATING THE LOCKABLE SAFETY AND HANDGUN LOCK

(76) Inventor: W. Thomas McClellan, P.O. Box 460460, Fort Lauderdale, FL (US) 33346

( * ) Notice: Subject to any disclaimer, the term of this patent is extended or adjusted under 35 U.S.C. 154(b) by 229 days.

(21) Appl. No.: 11/226,982

(22) Filed: Sep. 15, 2005

(65) Prior Publication Data

US 2007/0234622 A1 Oct. 11, 2007

(51) Int. Cl.
*F41A 17/00* (2006.01)

(52) U.S. Cl. ..... 42/66; 42/70.08

(58) Field of Classification Search ..... 42/70.01, 42/70.08, 70.11, 66

See application file for complete search history.

(56) References Cited

U.S. PATENT DOCUMENTS

| | | | | |
|---|---|---|---|---|
| 917,045 | A * | 4/1909 | Gates | 42/66 |
| 3,462,869 | A * | 8/1969 | Wallace | 42/70.08 |
| 4,136,475 | A * | 1/1979 | Centille | 42/70.11 |
| 4,461,110 | A * | 7/1984 | Inderbitzen | 42/66 |
| 4,967,502 | A * | 11/1990 | Vernon | 42/70.08 |
| 4,987,693 | A * | 1/1991 | Brooks | 42/70.11 |
| 5,671,560 | A * | 9/1997 | Meller | 42/70.11 |
| 5,910,003 | A * | 6/1999 | Kleinpaul | 42/70.11 |
| 6,523,294 | B2 | 2/2003 | Curry et al. | |
| 6,568,117 | B2 | 5/2003 | Weinraub | |

* cited by examiner

*Primary Examiner*—Michael J. Carone
*Assistant Examiner*—Gabriel J Klein
(74) *Attorney, Agent, or Firm*—Laurence A. Greenberg; Werner H. Stemer; Ralph E. Locher

(57) ABSTRACT

A handgun has a reliable, integrated, lockable safety/hammer lock which is easy to operate and inexpensive to manufacture. The handgun contains a frame having shaft receiving recesses, a hammer supported in the frame, and a lockable safety/hammer lock disposed in a slidable fashion in the frame. The safety/hammer lock has a locking shaft for engaging in the shaft receiving recesses and a hammer locking rail for preventing the hammer from actuating or cocking.

12 Claims, 6 Drawing Sheets

REVOLVER HANDGUN HAVING AN AMBIDEXTROUS, INTEGRATED, COMBINED, LOCKABLE SAFETY AND HANDGUN LOCK AND A METHOD OF OPERATING THE LOCKABLE SAFETY AND HANDGUN LOCK

BACKGROUND OF THE INVENTION

1. Field of the Invention

The invention relates generally to revolver handguns having an ambidextrous, integrated, selective, lockable safety device that can be used as a handgun lock, and further relates to an easy to operate, combined revolver handgun safety and handgun lock.

2. Description of the Related Art

Thousands of revolver handguns are purchased yearly for sport or home protection. Typically handguns are stored at home, not in gun safes but in unlocked areas accessible to others. As such, unattended and unsafed handguns provide a danger to the untrained and curious. Injuries and fatalities result from the accidental discharge of these unlocked handguns.

States are increasingly requiring that each new handgun be accompanied by a suitable handgun lock that meets certain standards: ease of use, effectiveness, reliability, and resistance to tampering.

Conventional handgun locking devices are generally separate entities that must be remembered, found and applied properly. They have two or more sides or parts that clamp around the trigger guard. These handgun locking devices are configured to immobilize the trigger. Some handgun locks have been shown without keyed locking configurations to allow quick access by adults but these sacrifice a significant degree of safety for unauthorized use.

Many of these handgun locks attempt to prevent access to the trigger group but leave the handgun hammer exposed or only marginally secured. In many cases the hammer can still be manipulated and the handgun fired.

A reliable and effective revolver handgun locking arrangement that deters tampering and prevents inadvertent discharges would be an advancement to the art.

A selective safety for revolver handguns rendering the revolver safe and non-fireable in one position and fireable in another position, such as used in rifles and shotguns, would be a distinct improvement to the revolver handgun art.

A selectable safety for revolver handguns and a firearm lock that can be secured in the off and unlocked position, returning the reliability and fireability that is normal for revolver handguns in that they do not have selective safeties that can impede rapid use.

U.S. Pat. No. 6,568,117 to Weinraub teaches a hammer and trigger lock device that incorporates a standard pad lock as the locking device. The Weinraub taught locking device is a bulky add-on feature, is not integrated into the handgun, and is easily displaced and not convenient or easy to use.

U.S. Pat. No. 6,523,294 to Curry et al. teaches a revolver hammer locking mechanism for locking the hammer by actuation of a tool. The post, when rotated sufficiently, extends from the hammer enough to strike the revolver frame and prevent full rotation of the hammer. This configuration is quite delicate, the post subject to heavy forces during rotation. The small screw out shaft is easily fractured and is unsafe and must be fully extended to impede hammer movement and the full force of rotation is applied to the end of the shaft ninety degrees to the axis and far from the supporting base. Therefore, it is prone to easy failure and scaring of the handgun frame. In addition, it is embedded in and is only a feature of the hammer and is not integrated with the handgun frame. Furthermore, it has no distinct on or off position. The extended post is unsupported and too frail to constitute an effective and dependable firearm lock.

SUMMARY OF THE INVENTION

It is accordingly an object of the invention to provide a revolver handgun having an ambidextrous, integrated, combined, lockable safety and handgun lock and a method of operating the lockable safety and handgun lock, which overcome the herein-mentioned disadvantages of the heretofore-known devices and methods of this general type. The invention provides a combined revolver handgun with a lockable safety, manufactured as an integral part of the handgun, which additionally operates effectively as a handgun lock, with the addition of the safety and locking features that can be turned off.

With the foregoing and other objects in view there is provided, in accordance with the invention, a revolver having an integrated hammer lock. The revolver, preferably a handgun, contains a frame having a shaft receiving recess, a hammer supported on the frame, and a hammer lock disposed in a slidable fashion in the frame. The hammer lock has a locking shaft for engaging in the shaft receiving recess for preventing the hammer from actuating. The invention teaches a simple and inexpensive hammer lock which is highly reliable as compared to prior art hammer locks and is integrated into the gun.

The invention further relates to a method for operating a revolver handgun with and ambidextrous multi-function lockable safety device and security keyed handgun lock located in the sliding safety, operating the safety engagements both in the safety and hammer preventing rotation of the hammer thereby locking the revolver or weapon. The device has the additional advantage of being able by the same fitted security key to be locked in the fireable or unlocked condition and a method of operating the device which overcome the disadvantage and the heretofore known device and methods of this general topic.

The sliding safety/handgun lock is therefore useable as an ambidextrous (operatable by either thumb) safety, rendering the revolver temporarily safe or nonfireable in its forward position by interlocking with the hammer contour feature and selectively in its rear-most position, thereby rendering the handgun unsafe or fireable by allowing unimpeded rotation of the hammer.

The ambidextrous sliding safety has a vertically moveable, thread on thread, locking shaft with a head adapted to receive a fitted security key. By actuating the key, with the security key engaging the head, the locking shaft can be moved on its thread on thread relation with the sliding safety, in an up and down motion within the sliding safety. As the locking shaft is rotated clockwise, the end of the locking shaft protrudes below the sliding safety and engages one or other of the two matching recesses in the handgun frame at the base of the sliding chamber. The forward recess allows the locking shaft to lock the safety in the forward or safe nonfireable position, securing the hammer from rotating or firing. Being operatable only with the security key, and being a lockable safety that renders the revolver handgun unfireable the device now constitutes an effective, strong, simple to use, reliable and tamper proof handgun lock.

In accordance with additional features of the invention, the sliding safety can be locked by actuating the vertically moveable, thread on thread locking shaft with the fitted security key, in the rear-most sliding chamber floor matching recesses. By locking the sliding safety in the unsafe or fireable position, the handgun is locked in the fireable condition as if it did not possess a selectable safety or handgun lock. This would be an advantage in certain situations like speed shooting contests, police or military encounters where reliable fireability is more important than firearm safety.

In accordance with additional features the sliding safety locking shaft can be locked in the up position, disarming either the locked safe or locked fireable condition allow the safety to be used as a typical selectable handgun safety.

In accordance with an added feature of the invention, the frame defines a pair of sliding rail chambers, and the hammer lock has sliding rails for sliding within the sliding rail chambers. The hammer lock can slide between a locking position and an unlocking position within the sliding rail chambers. The hammer has a bottom region, and the hammer lock has a hammer locking rail for engaging the bottom region of the hammer, preventing actuation of the hammer, when the hammer lock is in a locking position. The hammer lock is held in the unlocking position by its frictional engagement with the frame of the handgun. The lockable safety can slide between rear-most and forward-most position in the sliding rail chambers. The hammer having an indentation or latching contour on its bottom surface and the sliding lockable safety/handgun lock having a protrusion on its forward surface configured to mate with the hammer indentation, preventing rotation of cocking of the hammer.

In accordance with an additional feature of the invention, the locking shaft has a head adapted for receiving a key, and by actuating the key, with the key engaging the head, the locking shaft can be moved up and down within the hammer lock. The hammer lock has a shaft hole for receiving the locking shaft. The shaft hole has first threads and the locking shaft has second threads meshing with the first threads for moving the locking shaft up and down by actuation of the key turning the head.

In accordance with a further feature of the invention, the hammer lock has a top surface functioning as a thumb grip. Ideally, the thumb grip has a roughened surface for assisting in engaging a thumb. Preferably, the roughened surface is formed by ridges.

In accordance with another feature of the invention, the frame includes a frame base, a frame backing extending from the frame base in a generally vertical direction from the frame base, and a set of protrusions extending from the frame backing in a direction substantially parallel to the frame base. The protrusions and the frame base define the sliding rail chambers. In a preferred embodiment, the protrusions have a tapered end.

With the foregoing and other objects in view there is further provided, in accordance with the invention, a method of engaging a hammer lock installed in a gun having a hammer. The method includes the steps of sliding a hammer lock to a locked position in which the hammer is prevented from cocking, and locking the hammer lock in the locked position by rotating a locking shaft of the hammer lock into a recess formed in the frame of the gun.

In accordance with an added mode of the invention, there is the step of engaging a sliding rail of the hammer lock under the hammer for preventing the hammer from cocking.

In accordance with another mode of the invention, there is the step of applying thumb pressure to a thumb grip of the hammer lock for sliding the hammer lock to the locked position.

Other characteristic features of the invention are set forth in the appended claims.

Although the invention is illustrated and described herein as embodied in a revolver handgun having an ambidextrous, integrated, combined, lockable safety and handgun lock and a method of operating the lockable safety and handgun lock, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
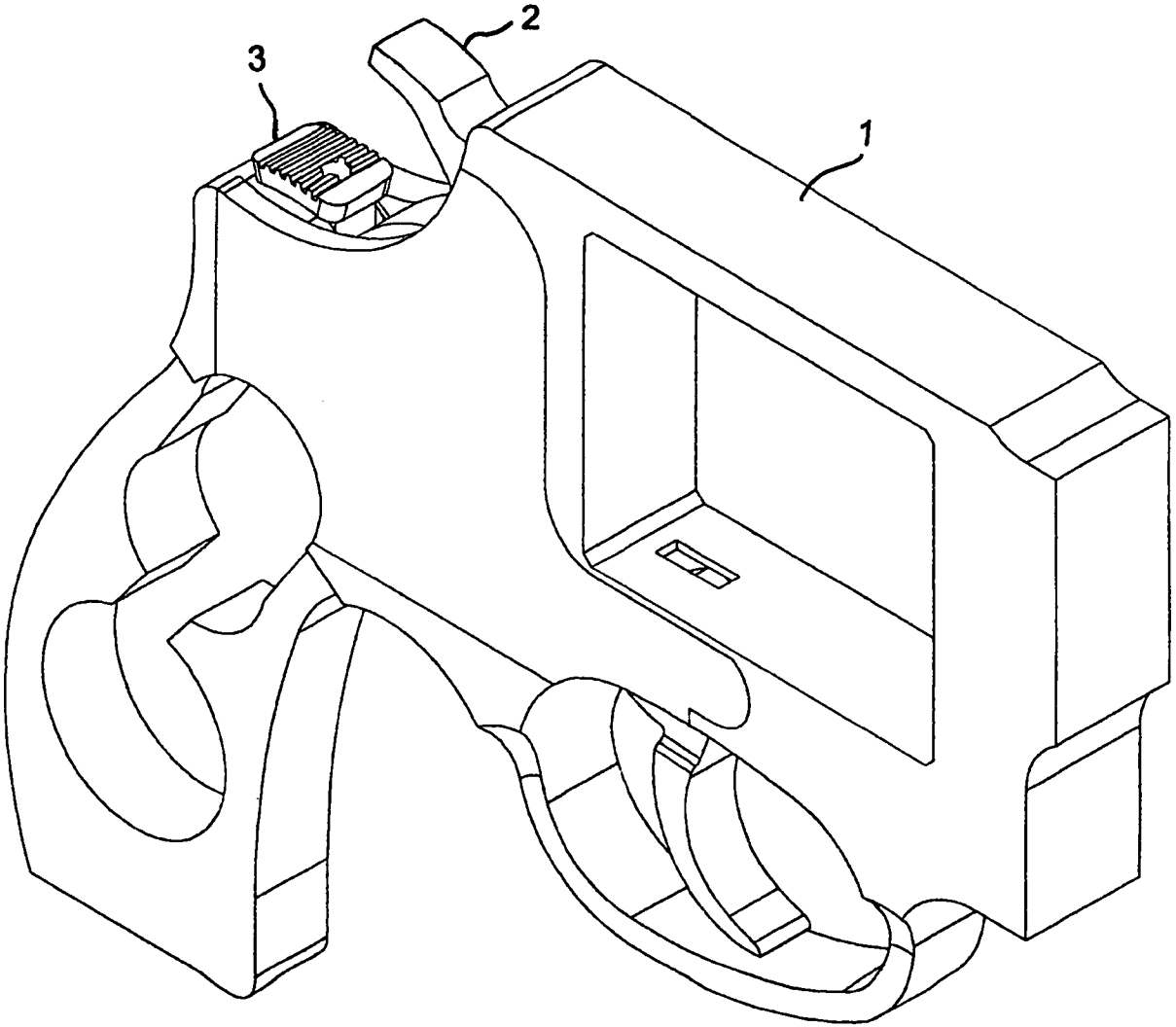
FIG. 1 is a diagrammatic, perspective view of a handgun frame having a hammer lock according to the invention.

Referring now to the figures of the drawings in detail and first, particularly, to FIG. 1 thereof, there is shown a double action revolver which generally includes a frame 1, a barrel, a hand grip, a hammer 2, a trigger, and a trigger guard. The handgun further includes a rotatable chambered cylinder wherein a plurality of bullets is contained so that the handgun may be fired several times without reloading.

The term double action refers to the two-part movement of the trigger during operation. Depressing the trigger results initially in a reverse movement or cocking of the hammer 2, which in its return movement, or firing motion, revolves the chambered cylinder and brings the next bullet in line for firing. In many handguns today, there is a trigger lock that prevents the trigger from being actuated. However, a bullet remains in the first chamber of the cylinder and the handgun may be accidentally fired if the hammer 2 is pulled back and released.

As shown in FIG. 1, a hammer lock 3 prevents the hammer 2 from being pulled or cocked into the firing position.

Figure 2:
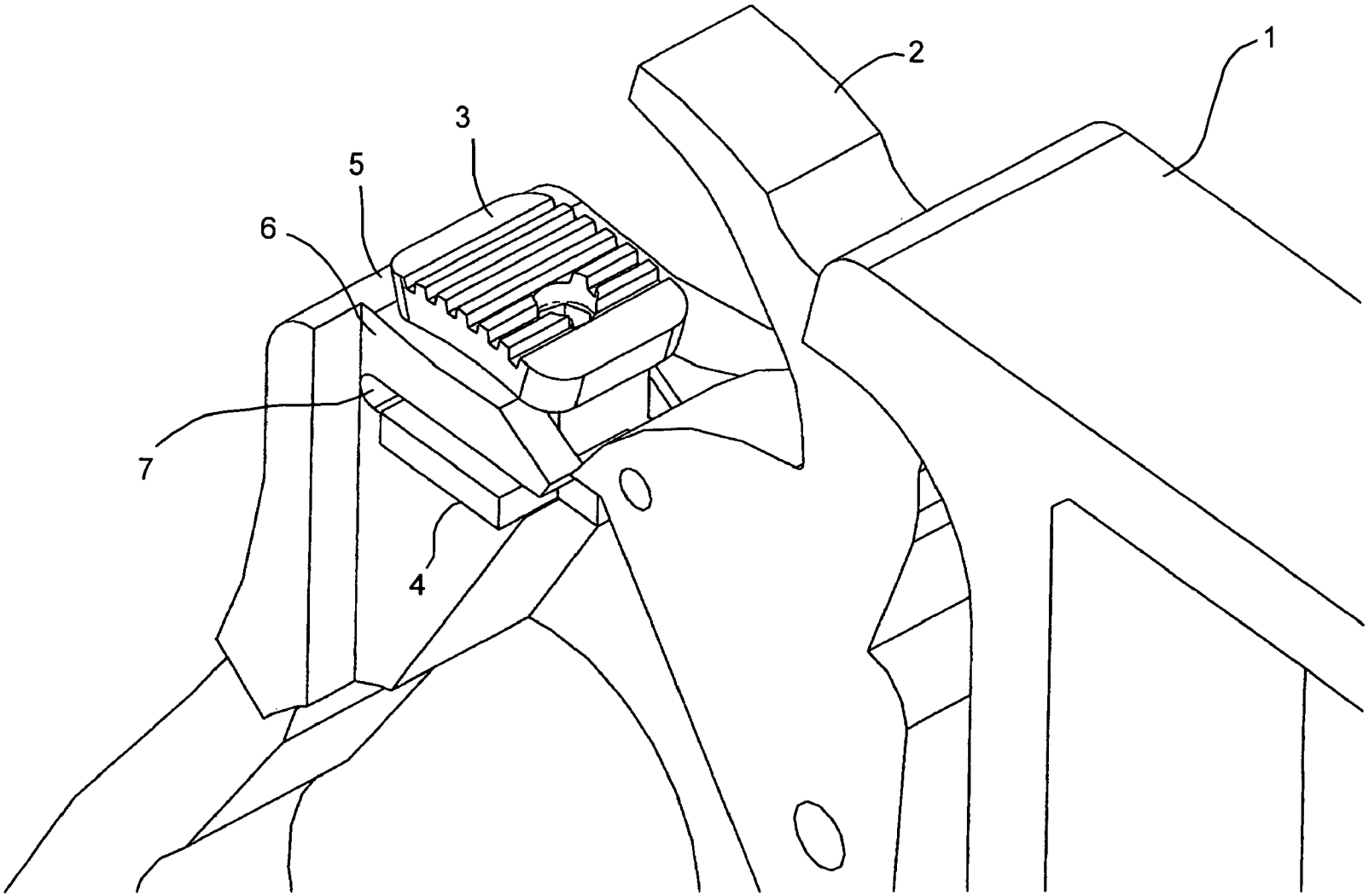
FIG. 2 is a diagrammatic, perspective view of the hammer lock in the handgun frame with a side plate of the handgun frame removed.

FIG. 2 shows an outline of the frame 1 of the handgun in which the hammer lock 3 is installed. As shown in FIG. 2, the hammer lock 3 is in a form fitting engagement with a frame base 4, a backing 5 and upper protrusions 6 with tapered ends. The frame base 4, the backing 5 and the upper protrusions 6 define a recess 7 into which the hammer lock 3 is fitted in a form fitting manner and a frictional manner. The recess 7 has sliding rail chambers 13 (see FIG. 3).

Figure 3:
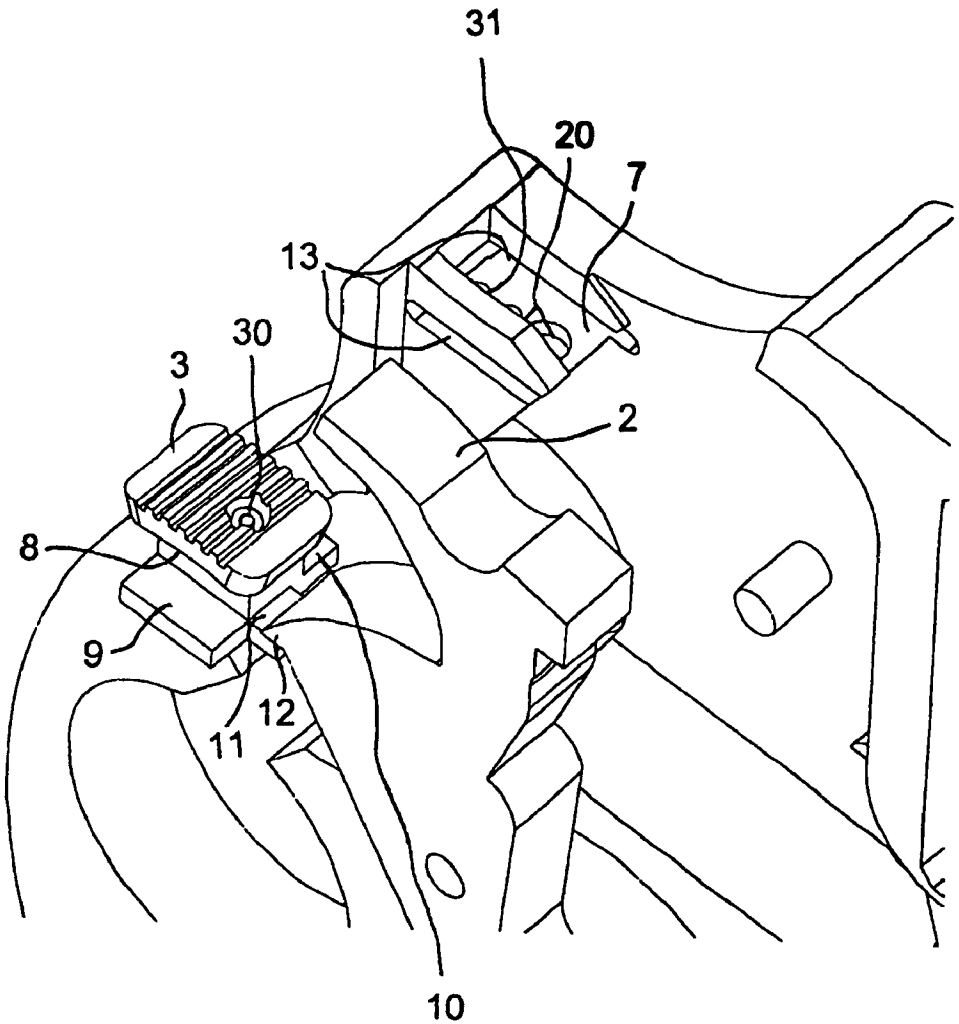
FIG. 3 is a diagrammatic, exploded, perspective view with the hammer and hammer lock removed from the frame of the handgun.

As shown in FIG. 3, the hammer lock 3 has a base 8 with a right side sliding rail 9 and a left side sliding rail 10 extending from the base 8 and sliding in the sliding rail chambers 13 and guided by the frame base 4 and upper protrusions 6. Extending from a front of the base 8 is a hammer locking rail 11 which engages under a bottom 12 of the hammer 2 and prevents the hammer 2 from cocking when the hammer lock 3 is in the locked position. FIG. 3 is an exploded view in which the hammer 2 and the hammer lock 3 are not yet installed on the frame 1 of the handgun. Within the frame 1 of the handgun and extending immediately below the recess 7 is a first shaft hole 20 for accepting a keyed locking shaft or post 21 of the hammer lock 3. A second shaft hole 31 is also formed in the frame 1.

Figure 4:
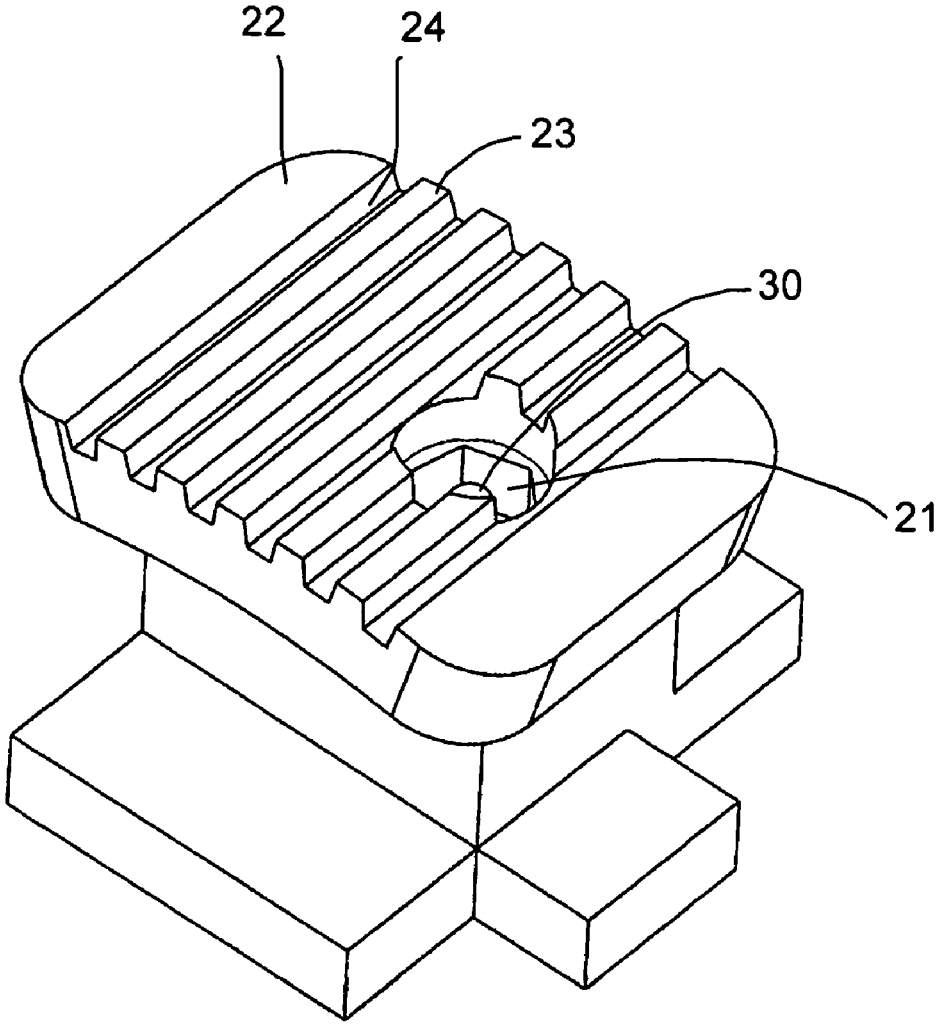
FIG. 4 is a diagrammatic, perspective view of the hammer lock.
Figure 5:
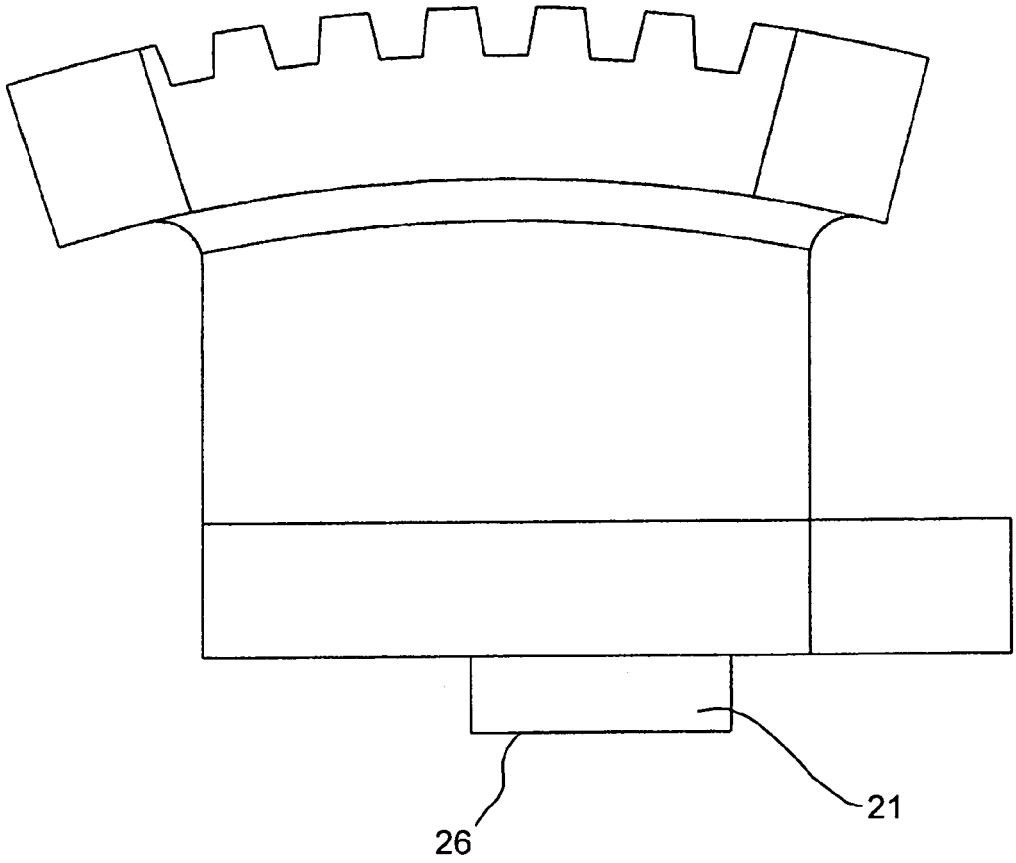
FIG. 5 is a diagrammatic, side-elevational view of the hammer lock.

As shown in FIG. 4, the hammer lock 3 has a top surface 22 functioning as a thumb grip 22 which assists in sliding the hammer lock 3 between a locking and unlocking position for locking and unlocking the hammer 2. The top surface 22 has ridges defined by a formation of peaks and valleys 23, 24 that help provide traction to the thumb of the user. Any type of roughened surfaced is acceptable and the ridged type surface is merely illustrative. As best seen in FIG. 5, the thumb grip 22 has an arcuate shape. Arcuate shapes provide an ideal shape for adapting to the thumb of the user and for providing the forces for moving the hammer lock 3 between the locked and unlocked positions.

Figure 6:
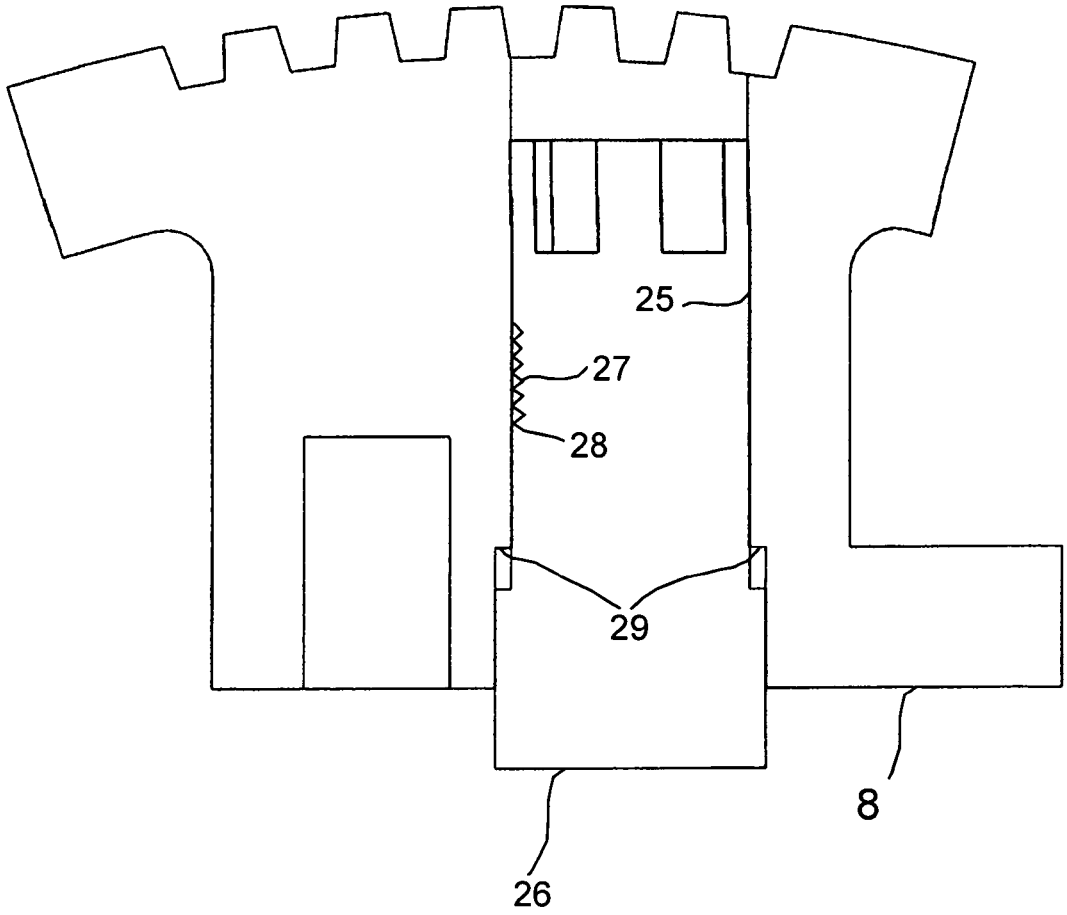
FIG. 6 is a diagrammatic, sectional view of the hammer lock.

Within the top surface 22 a shaft recess 25 is formed and holds the keyed locking shaft 21 (see FIGS. 4 and 6). The shaft recess 25 extends through to the bottom of the hammer lock 3. As shown in FIG. 5, a bottom 26 of the keyed locking shaft 21 can extend beyond and be retracted from a bottom of the base 8 of the hammer lock 3. In this manner, in a locked position, the bottom 26 of the keyed locking shaft 21 engages into the first shaft hole 20 and prevents the hammer lock from being slide. The first shaft hole 20 and the bottom of the keyed locking shaft 21 are adapted to each other for locking the hammer lock 3 in position. In the unlocked position the keyed locking shaft 21 may be housed completely within the shaft recess 25. In addition, the keyed locking shaft 21 may be secured in the second shaft hole 31 in a secured unlocked position. The keyed locking shaft 21 is moved within the shaft recess 25 by actuation of a key which in turn turns the keyed locking shaft 21. The key can be a simple Allen wrench, screw driver, or for higher security a specially configured "one of a kind" key matched to a head 30 of the keyed locking shaft 21. An outer circumference of the keyed locking shaft 21 is threaded 27 and inner walls of the shaft recess 25 are counter threaded 28 for meshing with the threads 27 for allowing the keyed locking shaft 21 to move up and down. The threads 27, 28 are shown enlarged and only diagrammatically in FIG. 6 for illustrative purposes and are not shown completely as this feature is well known in the art.

The shaft recess 25 is defined by shoulders 29 that act as stops 29 when the keyed locking shaft 21 is totally withdrawn into the shaft recess 25. When the keyed locking shaft 21 is totally withdrawn within the shaft recess 25, the bottom 26 of the keyed locking shaft 21 is fully contained in the shaft recess 25.

To move the hammer lock 3 from the unlocked position to the locked position, the hammer lock 3 is slide by thumb pressure within the sliding rail chambers 13. In this manner, the hammer locking rail 11 slides under the hammer 2, 12 and secures the hammer 2 from actuating.

With the hammer lock 3 moved to the locked position, the user rotates the keyed locking shaft 21 within the shaft recess 25 until the keyed locking shaft 21 is firmly within the first shaft hole 20 locking the hammer lock 3 in place. Of course, the hammer lock 3 may have been initially locked in the second shaft hole 31, where the user would have had to first unlock the keyed locking shaft 21 from the second shaft hole 31.

The hammer lock 3 is formed from plastic, metal, composites, hardened rubber and other suitable materials. For a long service life, the hammer lock is preferably made from metal.

The hammer lock offers three operable conditions: locked open or usable sliding selectable safety on a revolver handgun; locked safe or unfireable constituting handgun or firearm lock; and locked unsafe or fireable for the ultimate in firing reliability.

The invention has three overriding functions that are now summarized. Function One: with the safety keyed locking shaft or post 21 in the up or not engaged position the hammer lock 3 operates as a sliding selectable safety.

When positioned in its rear-most position and held by the friction of the parts and the safety latching bar 11 not engaged with the hammer 2, 12, the revolver handgun is in the unsafe or fireable condition. With the safety keyed locking shaft 21 still in the up position, the safety device can be selectively moved to its forward-most position with its forward hammer latch 11 now engaged with the matching hammer notch 12, impeding hammer movement or cocking of the hammer 2, rendering the revolver handgun unfireable or safety-on condition. The handgun safety is on but the handgun is not locked. A simple but effective revolver selectable safety device.

Function Two: with the hammer lock 3 moved to its forward-most position and the security keyed locking post 21 turned by the matching security key to its down position, now engaging the forward matching recess 20 at the floor of the sliding chamber rails, the sliding safety hammer lock 3 is now locked in position. Since the hammer engagement latch 12 is engaged with the matching hammer rail 11 preventing hammer rotation or cocking, the handgun is now locked. The handgun is rendered unfireable and locked with a simple, strong, integrated, effective, tamper resistant handgun lock.

Function Three: with the hammer lock safety device 2 moved to its rear-most position and the security key locking post 21 turned by the matching security key to its down position, now engaging the rear matching recess 31 at the floor of the sliding chamber rails, the sliding safety/hammer lock 3 is now locked in the safety off or fireable condition, rendering the revolver handgun as if it had no selectable safety or handgun lock, as may be needed when extreme reliability of function is critical as in emergency police or military operations, where weapon function becomes more critical than handgun safety.

I claim:

1. A revolver, comprising:

a frame having first and second shaft receiving recesses formed therein;

a hammer supported on said frame; and a hammer lock for sliding in said frame, between safety-on and safety-off positions;

said hammer lock having a locking shaft selectively:

a) engaging and being retained only in said first shaft receiving recess for preventing said hammer from being actuated in said safety-on position; or b) engaging and being retained only in said second shaft receiving recess for permitting said hammer to be actuated in said safety-off position; or c) disengaging and releasing retention from said first and second recesses for permitting said hammer lock to be slid between said safety-on and safety-off positions by engagement with the thumb of either hand holding the revolver.

2. The revolver according to claim 1, wherein:

said frame defines a pair of sliding rail chambers; and said hammer lock has sliding rails for sliding within said sliding rail chambers.

3. The revolver according to claim 1, wherein:

said hammer has a bottom region; and said hammer lock has a hammer locking rail for engaging said bottom region of said hammer, preventing actuation of said hammer, when said hammer lock is in a locking position.

4. The revolver according to claim 1, further comprising a key; and wherein said locking shaft has a head adapted for receiving said key, and by actuating said key, with said key engaging said head, said locking shaft can be moved up and down within said hammer lock.

5. The revolver according to claim 4, wherein said hammer lock has a shaft hole formed therein for receiving said locking shaft.

6. The revolver according to claim 2, wherein said hammer lock has a top surface functioning as a thumb grip.

7. The revolver according to claim 6, wherein said thumb grip has a roughened surface for assisting in engaging a thumb.

8. The revolver according to claim 7, wherein said roughened surface is formed by ridges.

9. The revolver according to claim 5, wherein:

said shaft hole has first threads;

said locking shaft has second threads meshing with said first threads for moving said locking shaft up and down, within said shaft hole, by actuation of said key turning said head.

10. The revolver according to claim 6, wherein said frame includes:

a frame base;

a frame backing extending from said frame base in a generally vertical direction from said frame base; and a set of protrusions extending from said frame backing in a direction substantially parallel to said frame base, said protrusions and said frame base defining said sliding rail chambers.

11. The revolver according to claim 10, wherein said protrusions have a tapered end.

12. The revolver according to claim 5, wherein:

said key is a one of a kind security key matched specifically to said head; and said shaft hole extends completely through said hammer lock.

* * * * *